US005363534A

United States Patent [19]

Dekker et al.

[11] Patent Number: 5,363,534

[45] Date of Patent: Nov. 15, 1994

[54] VACUUM CLEANER AND SUCTION TUBE FOR USE WITH A VACUUM CLEANER

[75] Inventors: Jan H. Dekker, Hoogeveen; Ate K. Damstra, Drachten, both of Netherlands

[73] Assignee: U.S. Philips Corporation, New York, N.Y.

[21] Appl. No.: 67,199

[22] Filed: May 25, 1993

[30] Foreign Application Priority Data

Jun. 19, 1992 [EP] European Pat. Off. ..... 92201787.6

[51] Int. Cl.[5] ..... A47L 9/28

[52] U.S. Cl. ..... 15/339; 15/412

[58] Field of Search ..... 15/377, 319, 339, 412

[56] References Cited

U.S. PATENT DOCUMENTS

| | | | |
|---|---|---|---|
| 3,579,706 | 5/1971 | Hetland | 15/377 X |
| 3,855,665 | 12/1974 | Schwartz | 15/339 |
| 4,419,783 | 12/1983 | Steffen | 15/339 |
| 4,654,924 | 4/1987 | Getz et al. | 15/377 X |
| 4,672,367 | 6/1987 | Damstra | 340/657 |
| 4,914,327 | 4/1990 | Dekker | 307/632 |
| 4,959,556 | 9/1990 | Dekker et al. | 307/261 |

*Primary Examiner*—Chris K. Moore

*Attorney, Agent, or Firm*—Ernestine C. Bartlett

[57] ABSTRACT

A vacuum cleaner is provided which comprises a housing (100) provided with an electric motor (110) and with an electronic circuit (120) for controlling the electric motor (110), which housing (100) is constructed for the connection of a suction tube (200) with a remote control circuit (210) for controlling the electronic circuit (120), the electronic circuit (120) being adapted to control the electric motor (110) both in the presence and in the absence of the suction tube (200).

9 Claims, 2 Drawing Sheets

VACUUM CLEANER AND SUCTION TUBE FOR USE WITH A VACUUM CLEANER

FIELD OF THE INVENTION

The invention relates to a vacuum cleaner comprising a housing provided with an electric motor and with an electronic circuit for controlling the electric motor, which housing is constructed for the connection of a suction tube with a remote control circuit for controlling the electronic circuit.

The invention also relates to a suction tube for use with such a vacuum cleaner.

Such a vacuum cleaner is suitable for general domestic use.

BACKGROUND OF THE INVENTION

Such a vacuum cleaner is commercially available from Philips Electronics N.V. under the type number HR 6780. The relevant commercially available vacuum cleaner comprises a suction tube with a remote control circuit adapted to switch on/off the electric motor of the vacuum cleaner and an electric motor of a brush, which brush can be fitted onto a suction nozzle forming part of the suction tube.

A drawback of such a vacuum cleaner is that the electric motor of the vacuum cleaner cannot be switched on/off when the suction tube provided with the remote control circuit is not coupled to the vacuum-cleaner housing.

SUMMARY OF THE INVENTION

An object of the invention is to provide a vacuum cleaner which can be switched on when the suction tube is not coupled to the housing.

A vacuum cleaner in accordance with the invention is characterized in that the electronic circuit is adapted to control the electric motor both in the presence and in the absence of the suction tube. With the relevant circuit constructed in accordance with the invention a vacuum cleaner is obtained which has several advantages in comparison with the above-mentioned commercially available vacuum cleaner. A first advantage of the circuit constructed in accordance with the invention is that a clogged suction tube can be coupled to the vacuum-cleaner housing in a reverse manner. In this way the suction tube can be unclogged. A second advantage of the circuit constructed in accordance with the invention is that a defect of the remote control circuit of the suction tube does not render the vacuum cleaner unserviceable. A third advantage of the circuit constructed in accordance with the invention is that the vacuum cleaner can be provided with a connection to which the suction tube can be coupled to provide a blower function.

An embodiment of a vacuum cleaner in accordance with the invention is characterized in that the housing has a first and a second supply voltage terminal, a conduction path via the suction tube is established between the electronic circuit and the first supply voltage terminal when the suction tube is present, and a conduction path via the housing is established between the electronic circuit and the first supply voltage terminal when the suction tube is absent. In the present embodiment a supply voltage appearing on the supply voltage terminals is supplied indirectly or directly to the electronic circuit depending upon the presence or absence of the suction tube. In the present embodiment the indirect supply is effected through the conduction path via the suction tube and the direct supply is effected through the conduction path via the housing. Switching over between the relevant conduction paths is achieved in a simple way when the housing and the suction tube are coupled by means of a coupling comprising at least one electrical connector which mechanically provides the conduction path via the suction hose when the suction tube is present and the conduction path via the housing when the suction tube is absent.

An embodiment of a vacuum cleaner in accordance with the invention is characterized in that a conduction path via the housing is established between the electronic circuit and the first supply voltage terminal when the suction tube is present. The present embodiment is advantageous in particular because the electronic circuit is coupled directly to the supply voltage terminals both when the suction tube is present and when it is absent. As a result of the direct coupling the electronic circuit is constantly supplied with the supply voltage from the supply voltage terminals, the conduction path via the suction tube not being used as a power-supply line but as a monitoring line. By means of the monitoring line the electronic circuit is informed whether the suction tube is present or absent. If the conduction path via the suction tube is used as a monitoring line the direct coupling reduces the likelihood of faults in the electronic circuit, in particular when the fault is caused by a supply voltage failure.

An embodiment of a vacuum cleaner in accordance with the invention is characterized in that the electronic circuit comprises a subcircuit for detecting the presence of the suction tube. In the embodiments described before the present embodiment, the electronic circuit need not comprise the subcircuit because the object of the invention can be achieved, for example, by the mechanical switching means provided in the coupling. However, the electronic circuit comprising the subcircuit can have a further advantage. To visualize the detection, the relevant embodiment may be characterized further in that the housing comprises a display, which display is coupled to the electronic circuit to indicate the presence and the absence of the suction tube, the housing provided with the display having the further advantage that a defect of the coupling between the housing and the suction tube can be detected. The display may then indicate the absence of the suction tube although the coupling has been established.

A suction tube for use with a vacuum cleaner in accordance with the invention is characterized in that the remote control circuit comprises means for detecting the presence or absence of the suction tube. The relevant means are capable not only of indicating the presence of the suction tube when the electric motor of the vacuum cleaner has been switched off by means of the remote control circuit but also of indicating the absence of the suction tube when the suction tube is disconnected from the housing, for example as a result of a coupling defect, in the case of a switched-on electric motor. Without the relevant means the design of the electronic circuit is the decisive factor with respect to the detection of a disconnected suction tube.

An embodiment of a suction tube for use with a vacuum cleaner in accordance with the invention is characterized in that said means comprise a first and a second resistor, the detection of the presence or absence of the suction tube by the electronic circuit being based on a difference in resistance value. This embodiment may be characterized further in that the remote control circuit comprises a switch which in a first position is capable of coupling the first supply voltage terminal and the electronic circuit via the first resistor, and in a second position is capable of coupling the first supply voltage terminal and the electronic circuit via the second resistor. As a result of the difference in resistance the first and the second resistor cause a difference in a voltage drop produced across the resistors, the detection by the electronic circuit being based on this difference.

BRIEF DESCRIPTION OF THE DRAWINGS

The above and other (more detailed) features of the invention will be described more elaborately with reference to the accompanying drawings, in which.

In these Figures like parts bear the same reference numerals.

DETAILED DESCRIPTION OF THE PREFERRED EMBODIMENTS

Figure 1A:
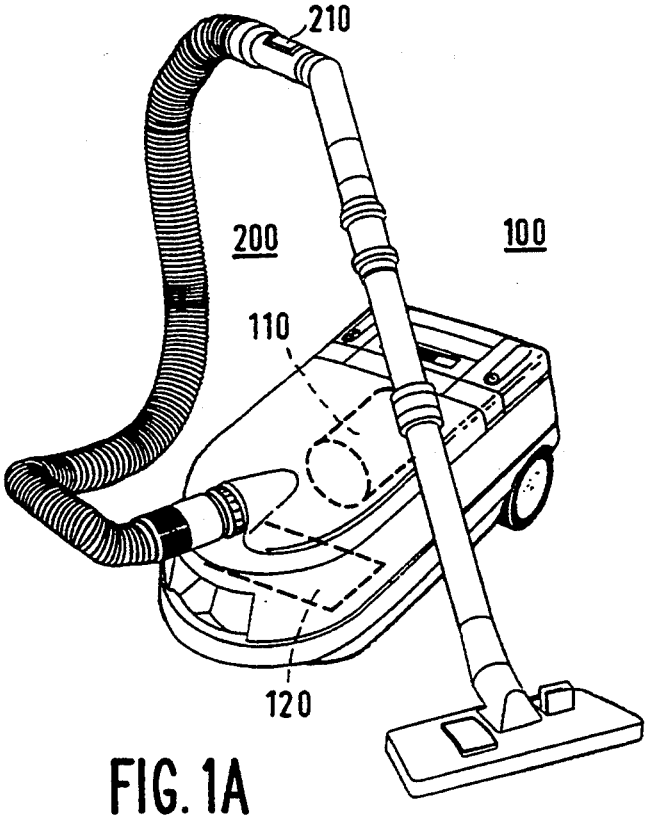
FIG. 1A shows a prior-art vacuum cleaner.

FIG. 1A shows a prior-art vacuum cleaner. The vacuum cleaner comprises a housing 100 accommodating an electric motor 110 and an electronic circuit 120 for controlling the electric motor 110, and a suction tube 200 connected to the housing 100 and provided with a remote control circuit 210 for controlling the electronic circuit 120. For controlling the electronic circuit 120 the suction tube 200 has been provided with electrical wiring which extends from the remote control circuit 210 to the housing 100 of the vacuum cleaner, the suction tube 200 and the housing 100 being coupled to one another by means of a coupling provided by electrical connectors. In the housing 100 wiring has been provided from the coupling to the electronic circuit 120 and the electric motor 110.

Figure 1B:
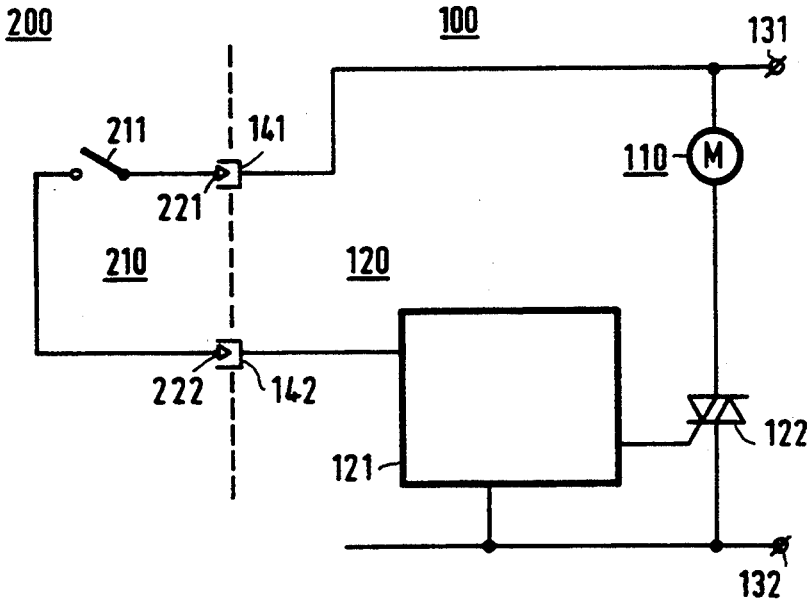
FIG. 1B shows an electronic circuit arrangement of a prior-art vacuum cleaner.

FIG. 1B shows an electronic circuit arrangement of a prior-an vacuum cleaner, for example the vacuum cleaner which is commercially available from Philips Electronics N.V. under the type number HR 6780. The electronic circuit arrangement comprises a part accommodated in the housing 100 and comprising the electric motor 110 and the electronic circuit 120, and a pan accommodated in the suction tube 200 and comprising the remote control circuit 210. The electronic circuit 120 comprises a control circuit 121 and a triac 122, the control circuit 121 being adapted to control the triac 122 for the purpose of controlling the electric motor 110, and the coupling between the housing 100 and the suction tube 200 comprises two connectors 141 and 142 which form pan of the electronic circuit 120 and two connectors 221 and 222 which form pan of the remote control circuit and cooperate with the first-mentioned connectors. In addition to the control circuit 121, the triac 122 and the two connectors 141 and 142 the electronic circuit 120 comprises a first supply voltage terminal 131 and a second supply voltage terminal 132, which supply voltage terminals are coupled to a mains supply lead, not shown. The remote control circuit 210 accommodated in the suction tube 200 and the control circuit 121 are serially coupled between the supply voltage terminals 131 and 132 and the electric motor 110 and the triac 122 are also serially coupled between these terminals, the control circuit 121 being switched on/off by the remote control circuit 210 when the suction tube 200 is present. For the purpose of switching on/off the remote control circuit comprises a switch 211 coupled between two connectors 221 and 222. Since the control circuit 121 is powered via the remote control circuit 210, the electric motor 110 cannot be switched on when the suction tube 200 with the remote control circuit 210 is not coupled to the housing 100.

Figure 2:
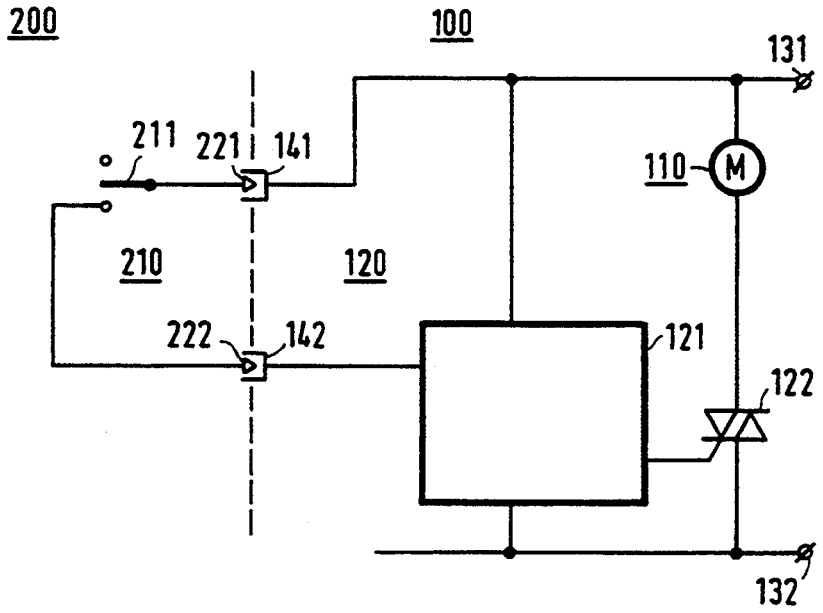
FIG. 2 shows an electronic circuit arrangement for a vacuum cleaner in accordance with the invention.

FIG. 2 shows an electronic circuit arrangement for a vacuum cleaner in accordance with the invention, which arrangement differs from that in FIG. 1B in that the supply voltage terminal 131 is connected to the control circuit 121 via a conduction path which extends through the housing 100. In comparison with that shown in FIG. 1B the arrangement shown in FIG. 2 has the advantage that the control circuit 121 can switch on the electric motor 110 in the absence of the suction tube. The control circuit 121, which forms part of the electronic circuit 120, is supplied directly with a supply voltage appearing on the supply voltage terminals 131 and 132, while the conduction path which in FIG. 2 extends between the supply voltage terminal 131 and the control circuit 121 via the suction tube is a monitoring path, the direct supply being advantageous in order to preclude faults in the electronic circuit. The control circuit 121 is preferably adapted to receive a logic "high" signal if the vacuum cleaner is switched off, and a logic "low" signal if the vacuum cleaner is switched on. This preference results from the fact that in the absence of the suction tube the control circuit 121 receives a logic "low" signal, so that on the basis of the applied signal the vacuum cleaner is switched on. If the control circuit 121 comprises a further switch the relevant switch can take over the on/off function of the remote control circuit in the absence of the suction tube 200. The control circuit 121 may also comprise a know motor control device with a plurality of power settings.

Figure 3:
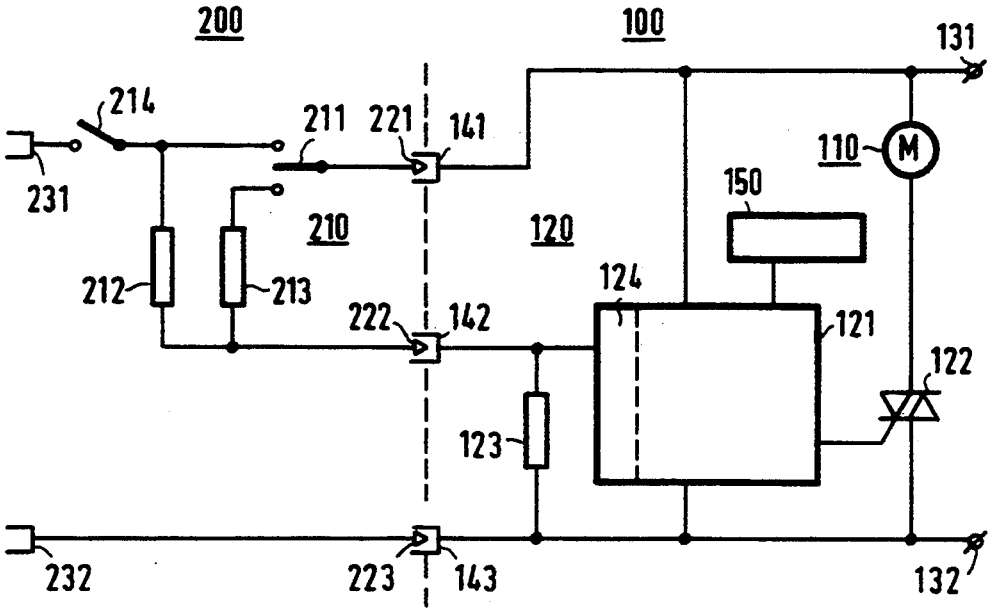
FIG. 3 shows a modified electronic circuit arrangement for a vacuum cleaner in accordance with the invention.

FIG. 3 shows a modification of the electronic circuit arrangement for a vacuum cleaner in accordance with the invention. In comparison with the arrangement shown in FIG. 2 the modification has the advantage that the electronic circuit detects whether the suction tube is present. In order to obtain this advantage the switch 211 of the remote control circuit 210 has a first position, in which a first conduction path between the supply voltage terminal 131 and the control circuit 121 is established, and a second position, in which a second conduction path between the supply voltage terminal 131 and the control circuit 121 is established, and the remote control circuit has a first resistor 212 included in the first conduction path and a second resistor 213 included in the second conduction path. Both in the first position and in the second position the resistors 212 and 213 form part of a voltage divider, for which voltage divider the electronic circuit comprises a resistor 123 coupled between the connector 142 and the supply voltage terminal 132. In the first position of the switch 211 a voltage is applied to the control circuit 121 by means of the voltage divider formed by the resistors 212 and 123, as a result of which voltage the electric motor 110 is switched on. In the second position of the switch 211 a voltage is applied to the control circuit 121 by means of the voltage divider formed by the resistors 213 and 123, as a result of which voltage the electric motor 110 is switched off. In order to obtain a difference between the voltages switching over of the switch 211 should be accompanied by a resistance variation and on/off function of the electric motor 110 is determined by a resistance variation, which resistance variation is detected by the subcircuit 124 of the control circuit 121. For the purpose of detection the subcircuit 124 may be realized, for example, by means of a comparator circuit. Summarizing, by means of the electronic circuit 120 shown in FIG. 3 and the remote control circuit 210 in FIG. 3 the control circuit 121 can detect whether the suction tube 200 is present and whether the electric motor 110 should be switched on. A further difference between the arrangement shown in FIG. 3 and that shown in FIG. 2 is constituted by the display 150 which forms part of the electronic circuit 120 and which is driven by the control circuit 121 to indicate the presence or absence of the suction tube 200. The display 150 has the advantage that a defect of the remote control circuit 210 can be detected simply. Indeed, in spite of the coupling established between the housing 100 and the suction tube 200 the display 150 may indicate that the suction tube 200 is absent. In addition to said difference FIG. 3 shows how an electric motor of a brush can be controlled, which brush can be fitted onto a nozzle forming part of the suction tube 200. In order to control this electric motor, the remote control circuit 210 comprises a connector 223, which forms part of the coupling and which cooperates with a connector 143 included in the electronic circuit, a switch 214, and two connectors 213 and 232. If the switch 211 is in the first position the electric motor of the brush belonging to the suction tube 200 can be switched on/off by means of the switch 214, the electric motor being connected between the two connectors 213 and 232. The use of the brush is known from the vacuum cleaner which is commercially available from Philips Electronics N.V. under the type number HR 6780.

The invention is not limited to the electronic circuit arrangements shown herein. Within the scope of the invention several modifications are conceivable to the expert. For example, as already stated in the present document, the vacuum cleaner may be provided with a coupling comprising electrical connectors, which coupling provides mechanical switching over between a supply line extending through the housing and a supply line extending through the suction tube. However, in the present case the electronic circuit is not constantly supplied with a supply voltage appearing across the supply voltage terminals. Moreover, the vacuum cleaner may be provided with a coupling which allows a suction tube without a remote control circuit to be connected, the electric motor being switched on/off by means of a switch forming part of the electronic circuit.

We claim:

1. A vacuum cleaner comprising a housing (100) provided with an electric motor (110) and with an electronic circuit (120) for controlling the electric motor (110), which housing (100) is constructed for the connection of a suction tube (200) with a remote control circuit (210) for controlling the electronic circuit (120), wherein the electronic circuit (120) is adapted to control the electric motor (110) both in the presence and in the absence of the suction tube (200).

2. A vacuum cleaner as claimed in claim 1, wherein the housing (100) has first and second supply voltage terminals (131, 132), a conduction path via the suction tube (200) is established between the electronic circuit (120) and the first supply voltage terminal (131) when the suction tube is present, and a conduction path via the housing (100) is established between the electronic circuit (120) and the first supply voltage terminal (131) when the suction tube is absent.

3. A vacuum cleaner as claimed in claim 2, wherein a conduction path via the housing (100) is established between the electronic circuit (120) and the first supply voltage terminal (131) when the suction tube (200) is present.

4. A vacuum cleaner as claimed in claim 3, wherein the electronic circuit (120) comprises a subcircuit (124) for detecting the presence of the suction tube (100).

5. A vacuum cleaner as claimed in claim 4, wherein the housing (100) comprises a display (150), which display (150) is coupled to the electronic circuit (120) to indicate the presence and the absence of the suction tube (200).

6. A vacuum cleaner as claimed in claim 5, wherein the remote control circuit (210) comprises means (212, 213) for detecting the presence or absence of the suction tube (200).

7. A vacuum cleaner as claimed in claim 6, wherein said means comprise first and second resistors (212, 213), the detection of the presence or absence of the suction tube (200) by the electronic circuit (120) being based on a difference in resistance value.

8. A vacuum cleaner as claimed in claim 7, wherein the remote control circuit (220) comprises a switch (211 ) which in a first position is capable of coupling the first supply voltage terminal (13 1 ) and the electronic circuit (120) via the first resistor (212), and in a second position is capable of coupling the first supply voltage terminal (131) and the electronic circuit (120) via the second resistor (213).

9. A suction tube for use in a vacuum cleaner, said vacuum cleaner comprising an electronic circuit for controlling an electric motor contained therein, and first and second supply voltage terminals; said suction tube comprising first and second resistors and a remote control circuit for controlling the electronic circuit, the remote control circuit also including a switch which in a first position is capable of coupling the first supply voltage terminal and the electronic circuit via the first resistor, and in a second position is capable of coupling the first supply voltage terminal and the electronic circuit via the second resistor.

* * * * *